United States Patent [19]

Manion et al.

[11] Patent Number: 4,838,168

[45] Date of Patent: Jun. 13, 1989

[54] ULTRAVIOLET CURED GAS SEAL FOR DISCARDING SABOT PROJECTILE

[75] Inventors: Michael C. Manion, Hopkins; Loren J. Walensky, Brooklyn Park; Francis J. Walker, Maple Grove, all of Minn.

[73] Assignee: Honeywell, Inc., Minneapolis, Minn.

[21] Appl. No.: 156,859

[22] Filed: Feb. 17, 1988

[51] Int. Cl.[4] ..... F42B 13/16

[52] U.S. Cl. ..... 102/522; 102/331; 102/523

[58] Field of Search ..... 269/3.1; 102/323, 331, 102/520, 521, 522, 523

[56] References Cited

U.S. PATENT DOCUMENTS

| | | | |
|---|---|---|---|
| H265 | 5/1987 | Bonde et al. | 102/521 |
| 3,894,492 | 7/1975 | Barr et al. | 102/93 |
| 3,911,824 | 10/1975 | Barr et al. | 102/92.7 |
| 4,187,783 | 2/1980 | Campoli et al. | 102/93 |
| 4,487,131 | 12/1984 | Luther | 102/523 |

*Primary Examiner*—Peter A. Nelson

*Attorney, Agent, or Firm*—Michael E. Whitham; C. Lamont Whitham

[57] ABSTRACT

A method of forming a gas seal without molds is provided by the use of a chemically modified silicon rubber that is rapidly polymerized upon exposure to ultraviolet radiation. The aft end of the sabot is coated with the rubber compound using spraying or flow coating technologies. The coating layer is deposited to a desired thickness. Then the coating layer is exposed to ultraviolet radiation which causes the polymerization of the silicone rubber compound. A hard, cured gas seal is produced by the polymerization reaction.

9 Claims, 1 Drawing Sheet

ULTRAVIOLET CURED GAS SEAL FOR DISCARDING SABOT PROJECTILE

BACKGROUND OF THE INVENTION

1. Field of the Invention

The present invention generally relates to a method of manufacturing a gas seal for a discarding sabot projectile and, more particularly, to manufacturing the gas seal from a chemically modified liquid silicone which is susceptible to polymerization upon exposure to ultraviolet (UV) radiation.

2. Description of the Prior Art

Sabot projectiles are used when launching a subcaliber warhead from an oversized gun barrel. These projectiles comprise plural sabot segment joined about the diameter of the warhead. When a projectile is launched from a gun barrel it acquires its initial velocity from the propulsive effect of the gun propellant gas pressure. The gas pressure is applied over the cross-sectional area of the projectile which is defined by the effective projectile diameter. The sabot segments serve to increase the effective projectile diameter, thereby permitting gas pressure in the gun barrel to act on a larger cross-sectional area. The circumference of the sabot contacts the bore of the gun and acts as a sealing surface which prevents the propulsion gases produced during firing from blowing past the warhead. Once the projectile has traversed the gun barrel, the sabot is discarded with each of the sabot segments dropping away from the warhead. The net effect of the sabot is that the projectile achieves a higher velocity and greater range.

Some of the problems with prior art discarding sabot designs have been related to increased propellant gas pressure and acceleration. The gas pressure and accelerating forces generate stress fields with hoop or circumferential tension components. These stresses frequently cause splits between the sabot segments which prematurely vent the propellant gas. Hence, an additional structural seal has been required for those areas exposed to the propellant gas pressure. In U.S. Pat. 3,620,167, Romer et al disclose a subcaliber projectile with a sabot having a gas pressure receiving surface that is covered with a flat sealing element made of elastic material. The sealing disc is made of a synthetic material and is secured to the aft end of the sabot by gluing or injection molding. In U.S. Pat. 4,598,644, Romer et al disclose a sealing foil made out of propellant charge which prevents gas from blowing past the sabot. The foil consists of desensitized propellant charge powder which has a slower burning velocity than the propellant, thereby assuring a seal between the segments of the sabot until the projectile traverses the gun barrel. In U.S. Pat. 4,424,768, Schiff shows a molded rubber base seal which covers the rearmost end of the sabot. In addition, the sabot includes a ring-like inner segmented seal consisting of three interlocking rubber pieces which provide further protection by preventing gas flow between the projectile and the sabot. At present, gas seals for discarding sabot projectiles are molded. Fabricating synthetic gas seals by molding techniques requires long cure cycle times and mold clean up.

In U.S. Pat. 4,187,783, Campoli et al disclose a discarding sabot munition with a self-adhering base seal member positioned in the aft end of the sabot segments. The seal member comprises a self-curing silicone rubber material such as Silgan H-622 which is manufactured by the SWS Silicone Corporation. The seal is made by extruding the self-curing material into a hole passageway system positioned between the joints of each adjacent sabot segment. The seal adheres to the aft face of the sabot assembly and extends into the seal hole passageway system. This seal is molded in place and requires specially constructed sabot segments.

Unlike some of the organic rubbers, particularly the newer thermoplastic rubbers, silicone rubber must be crosslinked or vulcanized in order to have useful properties. The crosslinking process is referred to as "curing". Free radical producing catalysts such as organic peroxides or azo compounds are mixed with the silicone and are used to initiate the cure reaction. High temperature exposure is used to split the peroxide into a pair of free radicals which will start the polymerization. More recently, liquid silicone rubbers which cure to a solid product at room temperature have been introduced into the market. These are categorically called room temperature vulcanizable (RTV) silicone rubbers and they sometimes are found in paste or semi-solid form. Recently, efforts have been made to use gamma and ultraviolet radiation for curing silicone rubber.

There is no teaching in the prior art of a non-molded, formed in place, gas seal for discarding sabot projectiles which is cured by exposure to UV radiation. Some conventional techniques for manufacturing the gas seal have relied upon materials requiring several hours of oven curing. Other conventional techniques have required substantial investment in expensive capital equipment such as molding machines and precision molds. Drawbacks of the prior art include the fabrication of molds, long heating cycle times, i.e., three to five hours, and mold clean up.

SUMMARY OF THE INVENTION

It is therefore an object of this invention to provide a method of making a seal used on the aft end of a sabot projectile which is compatible with automation and high volume production requirements.

It is another object of this invention to coat the aft end of a sabot with a polymeric material which is cured by exposure to ultraviolet radiation.

According to the invention, a chemically modified liquid silicone is applied to a designated area on the aft end of a sabot of a discarding sabot projectile using either spraying or flow coating technologies. Examples of a suitable liquid silicone include Loctite NUVASIL 88, which is produced by the Loctite Company of Connecticut, U.S.A. and is an acrylated silicone, and DC6256-03, which is produced by the DOW Corning Corporation of Midland, Mich., U.S.A., and includes a photo-initiator mixed with the liquid silicone. The coating is formed to any predetermined thickness. We have found the ideal thickness to be from 0.005 inches to 0.500 inches. The coating is then exposed to ultraviolet radiation. The ultraviolet radiation supplies the appropriate energy to initiate and facilitate the polymerization reaction. The polymerization proceeds rapidly and can be completed in 10 to 300 seconds depending on the thickness of the initial coating. Once the coating is cured, the projectile is ready for any additional processing operations, such as placement of an obturator around the sabot or placement of fins on the tail section of the projectile. The above-described process allows the seal to be formed more rapidly than conventional methods and at significantly less cost.

The purpose of a gas seal is to provide a momentary barrier able to withstand pressure from exploding propellant and to prevent intrusion of the resulting propellant gases between the sabot segments while the projectile traverses the gun barrel. Therefore, the coating must be thick enough to withstand the pressure from the propellant explosion and it must completely cover all the joints between the sabot segments. These two requirements are satisfied by spraying or flow coating a layer of unpolymerized liquid silicone on the aft end of sabot after the sabot segments have been joined around the warhead. No mold is required when forming the layer of liquid silicone. Ultraviolet radiation quickly cures the silicone layer to form a hardened gas seal. The silicone is bonded to the aft end of the sabot during the cure.

BRIEF DESCRIPTION OF THE DRAWINGS

The foregoing and other objects, aspects and advantages of the invention will be better understood from the following detailed description of the preferred embodiment of the invention with reference to the accompanying drawings, in which.

DETAILED DESCRIPTION OF THE PREFERRED EMBODIMENTS OF THE INVENTION

Figure 1:
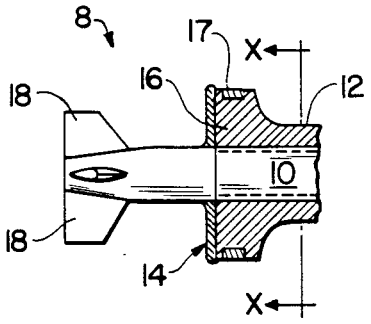
FIG. 1 is a side view of the aft end of a sabot projectile with a partial cut-away portion showing a cross-sectional view of the sabot positioned on the warhead wherein a gas seal is positioned on the aft end of the sabot.

Referring now to the drawings and, more particularly, to FIG. 1 wherein a sabot projectile 8 comprising a subcaliber warhead 10 and a sabot 12 includes a gas seal 14 positioned on the aft end 16 of the sabot 12. Exploding propellant acts against the larger diameter of the sabot 12, thereby allowing the subcaliber warhead 10 to achieve a greater velocity than if it had been fired from a smaller gun. An obturating band 17, which contacts the bore of the gun, serves to hold the sabot segments together as the sabot projectile traverses the gun barrel. After the sabot projectile 8 leaves the gun barrel, the sabot 12 is discarded and the subcaliber warhead 10 travels to its target. Fins 18 stabilize the warhead 10 in the course of its flight.

Figure 2:
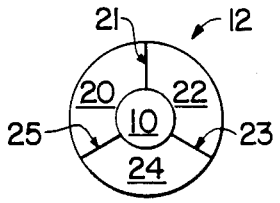
FIG. 2 is a cross-sectional view of the sabot projectile shown in FIG. 1 as seen from line X—X looking toward the fins of the projectile showing sabot segments spaced radially around the warhead body.

FIG. 2 shows that the sabot 12 comprises a plurality of sabot segments 20, 22, and 24. The joining faces of the sabot segments 20, 22, and 24 create joints 21, 23, and 25. The gas seal 16 shown in FIG. 1 serves to prevent propellant gases from blowing past the warhead 10 by passing through the joints 21, 23, and 25. The purpose of a gas seal is to provide a momentary barrier able to withstand pressure from exploding propellant and to prevent intrusion of the resulting propellant gases between the sabot segments while the projectile traverses the gun barrel. At present, gas seals for discarding sabot projectiles are molded. This technique involves the fabrication of molds, long cycle times, and mold clean up.

Figure 3:
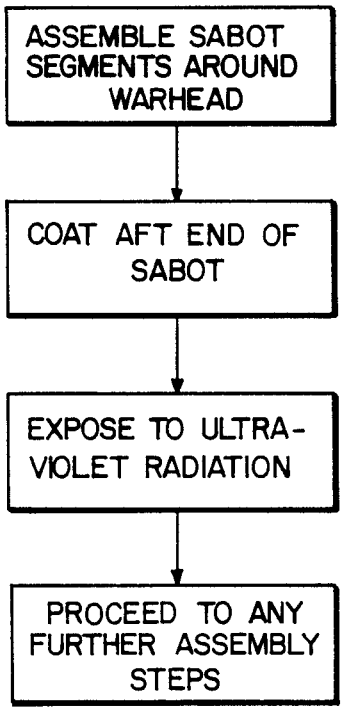
FIG. 3 is a flow diagram illustrating the process of forming a non-molded gas seal on the aft end of a sabot wherein a layer of chemically modified silicone is cured by ultraviolet radiation.

FIG. 3 shows the process steps for forming a non-molded gas seal on the aft end of a sabot wherein the seal is formed in a matter of seconds rather than hours. First, the sabot segments are assembled around the diameter of the warhead by conventional methods. Second, a chemically modified liquid silicone coating is applied to the aft end of the sabot using either spraying or flow coating technologies. In a spraying operation, a specified amount of chemically modified liquid silicone material is sprayed on the aft end of the sabot covering all exposed aft faces. Desirable results have been obtained with a conventional household paint sprayer. In a flow coating operation, the projectile and sabot are placed on a turn table with the warhead pointing downward. A nozzle is used to extrude a specified amount of material onto the aft end of the sabot in the form of a ring around the warhead on the aft end of the sabot. The turn table rotates the projectile such that the ring of material flow coats a layer over all exposed aft faces. The coating is formed to any predetermined thickness and is of a thixotropic consistency which permits the layer to stay in place for a short period of time. We have found the ideal thickness to be from 0.005 inches to 0.500 inches. Examples of a suitable liquid silicone include Loctite NUVASIL 88, which is produced by the Loctite Company of Connecticut, U.S.A., and is an acrylated silicone, and DC6256-03, which is produced by the DOW Corning Corporation of Midland, Mich., U.S.A., and includes a photo-initiator mixed with the liquid silicone. Third, the coating is exposed to ultraviolet radiation from any suitable source. The ultraviolet radiation supplies the appropriate energy to initiate the polymerization reaction. The polymerization proceeds rapidly and can be completed in 10 to 300 seconds depending on the thickness of the coating of liquid silicone. Ultraviolet radiation quickly cures the silicone layer to form a hardened gas seal. The silicone is bonded to the aft end of the sabot during the cure. Fourth, the projectile is ready for any additional processing operations, such as installing the fins on the warhead.

The above-described process allows the seal to be formed more rapidly than conventional methods and at significantly less cost. Non-molded, as disclosed in this application, means that no mold is required to form the seal. The silicone rubber layer coated on the aft end of the sabot simply needs to be sprayed or flow coated on the aft end of the sabot using conventional technologies. The layer is of a thixotropic consistency which permits the layer to stay in place for the short ultraviolet radiation exposure times required. The gas seal thus formed prevents propellant gases from blowing past the warhead through the joints between sabot segments. The seal is degraded by the abrasive nature of the propellant during combustion and the sabot segments are permitted to fall away from the warhead after the sabot projectile traverses the gun barrel While the invention has been described in terms of the preferred embodiment which includes specific chemically modified silicone rubber compounds being cured by ultraviolet radiation to form a non-molded gas seal, those skilled in the art will recognize that other compounds may be substituted in the practice of the invention within the spirit and scope of the appended claims.

Having thus described our invention, what we claim as novel and desire to secure by letters patent is the following;

1. A method for forming a non-molded gas seal on the aft end of a sabot, comprising the steps of:

coating an aft end of a sabot with a compound capable of photo-initiation and rapid polymerization;

exposing said compound to ultraviolet radiation, whereby said ultraviolet radiation photo-initiates a polymerization reaction of said compound; and forming a non-molded gas seal on said aft end of said sabot by polymerizing nearly all of said compound to form a hard, cured compound.

2. A method of forming a non-molded gas seal as recited in claim 1 wherein said coating step comprises spraying a layer of said compound on said aft end of said sabot to a designated thickness.

3. A method of forming a non-molded gas seal as recited in claim 2 wherein said exposing step is continued during said forming step, the time of said exposing step and said forming step being dependent on said thickness of said layer of said compound on said aft end of said sabot.

4. A method of forming a non-molded gas seal as recited in claim 1 wherein said coating step comprises flow coating a layer of said compound on said aft end of said sabot to a designated thickness.

5. A method of forming a non-molded gas seal as recited in claim 4 wherein said exposing step is continued during said forming step, the time of said exposing step and said forming step being dependent on said thickness of said layer of said compound on said aft end of said sabot.

6. A non-molded gas seal for a sabot, said gas seal being made by the following process:

coating an aft end of said sabot with a compound capable of photo-initiation and rapid polymerization;

exposing said compound to ultraviolelt radiation, whereby said ultraviolet radiation photo-initiates a polymerization reaction of said compound; and forming a non-molded gas seal on said aft end of said sabot by polymerizing nearly all of said compound to form a hard, cured compound.

7. A non-molded gas seal as recited in claim 6 wherein said compound comprises a modified silicone rubber composition.

8. A non-molded gas seal for a sabot formed from a compound capable of photopolymerization by exposure to ultraviolet radiation wherein said compound has been placed on an aft end of said sabot and subsequently exposed to ultraviolet radiation.

9. A non-molded gas seal as recited in claim 8 wherein said compound comprises a modified silicone rubber composition.

* * * * *